United States Patent [19]

Reinehr et al.

[11] 4,265,971

[45] May 5, 1981

[54] HYDROPHILIC FILAMENTS AND FIBRES OF POLYCARBONATES WITH A HIGH SECOND ORDER TRANSITION TEMPERATURE

[75] Inventors: Ulrich Reinehr; Béla von Falkai, both of Dormagen; Horst Wilschinsky, Odenthal, all of Fed. Rep. of Germany

[73] Assignee: Bayer Aktiengesellschaft, Leverkusen, Fed. Rep. of Germany

[21] Appl. No.: 105,822

[22] Filed: Dec. 20, 1979

[30] Foreign Application Priority Data

Jan. 10, 1979 [DE] Fed. Rep. of Germany ..... 2900703

[51] Int. Cl.[3] ..... D02G 3/00

[52] U.S. Cl. ..... 428/376; 264/205; 428/392; 428/397; 428/412

[58] Field of Search ..... 428/373, 376, 392, 394, 428/397, 398, 412, 401; 264/205

[56] References Cited

U.S. PATENT DOCUMENTS

| | | | |
|---|---|---|---|
| 3,385,814 | 5/1968 | Falkai et al. | 264/205 |
| 3,454,526 | 7/1969 | Rellensmann | 264/205 |
| 3,574,814 | 4/1971 | Falkai et al. | 264/205 |
| 3,914,354 | 10/1975 | Ueki et al. | 264/205 |
| 4,185,059 | 1/1980 | Reinehr | 264/205 |

*Primary Examiner*—James J. Bell

*Attorney, Agent, or Firm*—Sprung, Felfe, Horn, Lynch & Kramer

[57] ABSTRACT

Dry-spun hydrophilic core-jacket filaments and fibres of polycarbonates having a porosity and a water retention capacity of at least 10%, a mercury density of less than 1.0 g/cc, a strength of at least 1.5 cN/dtex and a second order transition temperature of at least 125° C. and a method for producing said filament and fibres by a dry-spinning process, wherein, immediately on leaving the spinnerette but before solidifying, the filaments are brought into contact with steam.

2 Claims, No Drawings

HYDROPHILIC FILAMENTS AND FIBRES OF POLYCARBONATES WITH A HIGH SECOND ORDER TRANSITION TEMPERATURE

It is known from German Offenlegungsschrift No. 2,554,124 that hydrophilic filaments and fibres can be produced from filament-forming synthetic polymers by adding to the spinning solvent from 5 to 50% by weight, based on the solvent and solids, of a substance which is essentially a non-solvent for the polymer, which has a higher boiling point than the solvent used and which is readily miscible with the spinning solvent and with a liquid suitable for washing the filaments, and subsequently washing out this non-solvent from the filaments produced. Preferred non-solvents in this process are polyhydric alcohols, such as glycerol, sugars and glycols.

Fibres such as these spun from acrylonitrile polymers, for example, have a core-jacket structure and a water retention capacity of at least 10%.

If this principle is applied to the production of hydrophilic fibres from polycarbonates, for example from the polycarbonate based on 4,4'-dihydroxydiphenyl-2,2-propane, hydrophilic polycarbonate fibres having a core-jacket structure and a water retention capacity of at least 10% are again obtained under suitable spinning conditions, but unfortunately their second-order transition temperature is greatly reduced and is generally of the order of 75° C., whereas pure polycarbonate fibres have a second order transition temperature of from 148° to 158° C. (cf. B. V. Falkai, Lenzinger Berichte, Folge 32, December 1971, page 43). As a result, a significant advantage of polycarbonate fibres, namely their resistance to creasing and boiling, is lost.

The non-solvent added, for example tetraethylene glycol, obviously acts as an internal plasticiser which reduces the second-order transition temperature (see Comparison Example 6 and Table II). Accordingly, attempts have been made to provide hydrophilic filaments produced by a spinning process of the type in question with a high second-order transition temperature by intensively washing out the non-solvent before the drawing process. As Comparison Examples 7 to 9 (see Table II) show, it is not possible, despite intensive washing for several hours, to reduce the non-solvent content to below 10%.

It has now surprisingly been found that hydrophilic polycarbonate fibres having a core-jacket structure and high second-order transition temperature can be obtained by carrying out the spinning process in the presence of steam.

Accordingly, the present invention provides dry-spun, hydrophilic core-jacket filaments or fibres of polycarbonates having a second-order transition temperature of at least 125° C., a mercury density of at most 1.0 g/cc and a strength of at least 1.5 centinewtons/dtex.

The invention also provides a process for producing these hydrophilic polycarbonate fibres by dry spinning which is characterised in that, immediately after emerging from the spinning jet, but at the latest at a time when they have not completely solidified, the filaments are brought into contact with an adequate quantity of steam at duct temperatures of at most 140° C.

This spinning process is in principle a conventional dry spinning process, preferably from strongly polar organic solvents, such as dimethyl formamide, dimethyl acetamide or dimethyl sulphoxide, which have a boiling point above 100° C. If lower-boiling solvents, for example methylene chloride, are used, there is a danger of excessive solvent depletion in the spinning duct under the spinning conditions applied, with the result that the non-solvent, steam, can no longer penetrate quite so intensively into the filaments because they have already solidified to too large an extent. As a result, a large part of their hydrophilic character is lost.

The width of the jacket surface, the hydrophilic character and, hence, also the pore volume and density of the filaments may be controlled both by adjusting the point at which and the intensity with which the steam is blown onto the polymer filaments and by adjusting the thermal conditions prevailing in the spinning duct.

It has been found that a core-jacket structure, a water retention capacity of greater than 10% and fibre densities of less than 1.0 g/cc are always obtained when spinning is carried out at low duct temperatures of at most 140° C. In order to avoid excessive condensation of steam and solvent in the spinning duct, a duct temperature above 100° C. and preferably in the range of from 105° to 125° C. has proved to be optimal. At higher duct temperatures, particularly at duct temperatures above 160° C., distinctly lower water retention values of, in some cases, below 10% and higher fibre densities of normally more than 1.0 g/cc are obtained.

The degree of hydrophilicity which can be obtained and the density of the fibres are determined not only by the duct temperature but also by the amount of steam used. In general, the hydrophilic character of the filaments increases whilst their density decreases with increasing quantities of steam (cf. Examples 2 to 5).

Accordingly, the amount of steam which has to be used to obtain a required degree of hydrophilicity may readily be determined in dependence upon the other spinning conditions applied. In general, the minimum quantity of steam blown in which is required to obtain hydrophilic core-jacket fibres having a water retention capacity of greater than 10% in a spinning process carried out in a steam/air atmosphere of 30 $m^3$/h amounts to approximately 2 kg per kg of spun material.

In the process according to the invention, the steam is preferably blown in above the spinning jet in the air flow and filament take-off direction. However, the steam may also be blown in across the filaments below the jet, provided it is blown in at such a rate that no excessive turbulence is generated.

In the dry spinning of polycarbonate solutions from dimethyl formamide, solution temperatures above 120° C. are required to keep the solutions free-flowing and spinnable. Similarly, high air temperatures of more than 300° C. and air throughputs of greater than 30 $m^3$/hour have proved to be effective for solidifying the filaments.

In the process according to the invention, therefore, spinning is preferably carried out in a steam/air atmosphere.

Another important property of the hydrophilic polycarbonate filaments for obtaining good processibility and serviceability is an adequate strength of at least 1.5 and preferably at least 2 centinewtons/dtex. The hydrophilic core-jacket polycarbonate fibres according to the invention do not lend themselves to normal drawing in a ratio of about 1:5 to 1:6 over heating godets at temperatures above the second order transition temperature of 180°–220° C., because porosity is lost at temperatures as high as these. On the other hand, a maximum drawing of only 1:2 is obtained in boiling water, corresponding to a fibre strength of less than 1.5 centinewtons/dtex. If higher drawing ratios are applied, capillary breaks occur to an increased extent. It has now been found that the drawing ratio can be increased to between about 1:3.5 and 1:3.8 by drawing the hydrophilic polycarbonate filaments in water containing approximately 30% by weight of DMF at a temperature of 95° to 100° C. and with residence times of at most 2 seconds. With longer residence times, the individual capillaries adhere to one another. If the composition of the drawing bath is changed, the maximum drawing level falls again. For example, the hydrophilic polycarbonate filaments can only be drawn in a ratio of at most 1:2.7 in water containing 50% by weight of DMF. In water containing 40% by weight of DMF, the maximum drawing ratio increases to 1:3.6 whereas, in water containing 30% by weight of DMF, drawing can still be carried out in ratio of about 1:3.8. It has proved to be advantageous to carry out drawing in the drawing bath as soon as possible after the spinning process because, after intermediate storage for a few days, the maximum drawing ratios may be distinctly lower. It is also advantageous to carry out two-fold drawing by initially drawing the filaments in air immediately after they leave the duct and subsequently subjecting them to the described bath drawing process. In this way, it is possible to obtain total drawing ratios which still exceed the above-mentioned maximum drawing ratio in the drawing bath, for example a total drawing ratio of 1:6.

Hydrophilic polycarbonate fibres produced in this way have a strength of at least 1.5 centinewtons/dtex.

Filaments or fibres obtained by the process according to the invention have a matted, wadding-like appearance. They are particularly suitable for use as self-absorbing fleeces and tampons. By virtue of their resistance to boiling, they are preferably used for sanitary articles.

The physical properties mentioned above were determined by the methods described in the following. These methods relate to dyed and blank-dyed fibres, yarns or sheet-textiles freed from any preparation applied. The cross-sectional structure of the core-jacket fibres was determined from photographs taken with an electron microscope.

METHODS

Determination of mercury density ($\rho$Hg)

After the test specimen has been heated in vacuo ($10^{-2}$ mbar) at 50° C., its Hg density (mean apparent density) is determined by volume measurements in mercury under an excess pressure of 10 bars.

Determination of helium density ($\rho$He)

After the test specimen has been heated in vacuo ($10^{-2}$ bars) at 50° C., its helium density ("true density") is determined by volume measurements in helium using a gas comparison pycnometer.

Definition of porosity (P)

$$P = 1 - (\rho Hg/\rho He) \cdot 100\%$$

Determination of water retention capacity (WR)

The water retention capacity is determined in accordance with DIN 53 814 (cf. Melliand Textilbereichte 4 (1973), page 350).

The fibre specimens are immersed for 2 hours in water containing 0.1% of wetting agent. Thereafter, the fibres are centrifuged for 10 minutes with an acceleration of 10,000 m/sec.$^2$ and the quantity of water retained in and between the fibres is gravimetrically determined. To determine their dry weight, the fibres are dried at 105° C. until they have a constant moisture content. The water retention capacity (WR) in % by weight is:

$$WR = \frac{m_f - m_{tr}}{m_{tr}} \times 100$$

$m_f$ = weight of the moist fibres
$m_{tr}$ = weight of the dry fibres

Determination of the second order transition temperature ($E_T$)

The fibre specimen is heated in an oven at a heating rate of 5° C./minute under a bias of 15 mN/tex and examined with a Perkin-Elmer TMS-1 thermomechanical analyser. On reaching the second order transition temperature, the fibres become highly plastic and begin to flow. The corresponding second order transition temperature ($E_T$) is obtained by extrapolation onto the temperature axis of the temperature-elongation graph (abscissa = heating temperature).

The invention is further illustrated by the following Examples in which the parts and percentages quoted are based on weight, unless otherwise indicated.

EXAMPLES 1 to 5

1 a: 74 kg of dimethyl formamide are mixed in an autoclave at room temperature with a polycarbonic acid ester of 4,4'-dihydroxydiphenyl-2,2-propane (MW approximately 80,000; $\eta_{rel}$=2.2 in 0.5% methylene chloride solution). The mixture is then heated with stirring for 3 to 4 hours to 130° C. and the spinning solution is delivered by a gear pump to a heating vessel where it is kept at 130° C. The residence time in the heating vessel is 3 minutes. The spinning solution is then filtered and then directly delivered to a 240-bore spinning jet. 40 kg/hour of saturated steam are blown into the spinning duct above the spinning jet. The duct temperature is 125° C. and the temperature of the spinning solution, as measured at the entrance to the jet, is also 125° C. 40 m$^3$/h of air at 420° C. are also blown in . Approximately 9 kg of steam are used per kg of spun material produced. The filaments which have a total denier of 2400 dtex, are collected on bobbins and combined to form a tow having a denier of 240,000 dtex. The tow is then drawn in a ratio of 1:3.8 in water containing 30% dimethyl formamide and having a temperature of 100° C. The residence time in the drawing bath is approximately 2 seconds. The tow is then washed, treated with an antistatic preparation, dried at 120° C., crimped and cut into staple fibres having a length of 60 mm. The individual fibres, which have a final denier of 3.3 dtex, have a strength of 2.2 centinewtons/dtex and a water retention capacity according to DIN 53 814 of 93%. The fibres have a pronounced core-jacket structure for a round cross section. The jacket surface makes up approximately 18% of the total cross-sectional area. The fibres have a second order transition temperature of 129° C.

The individual fibres have a helium density of 1.225 g/cc, a mercury density of 0.572 g/cc and a porosity of 53.3%.

1 b: Part of the doubled fibre tow having a total denier of 240,000 dtex is drawn in boiling water. The maximum degree of draw amounts to between about 200 and 220%, after which capillary breaks occur to an increased extent in the drawing bath. Fibres aftertreated in this way have a strength of 1.3 centinewtons/dtex for an individual final denier of 4.6 dtex.

Table I below contains further Examples. The spinning solutions are spun into core-jacket fibres having a final denier of 3.3 dtex and aftertreated in the same way as in Example 1 a. The quantity of steam and the duct temperature are varied during the spinning process. The quantity of air, the air temperature and the temperature of the spinning solution remain constant at 40 $m^3$/hour, 420° C. and 125° C. respectively. With air throughputs of less than 20 $m^3$/hour, air temperatures below 300° C. and solution temperatures below 110° C., spinning is no longer possible because the filaments do not solidify. The above described polymer was used as the solid in the ratios by weight indicated.

TABLE I

| Example No. | Quantity of steam in kg per kg of spun material | Duct temperature °C. | WR (according to DIN 53 814 in %) |
|---|---|---|---|
| 2 | 12 | 125 | 112 |
| 3 | 6 | 125 | 39 |
| 4 | 3 | 125 | 17 |
| 5 | 9 | 140 | 47 |

| Example No. | Helium density g/cc | Hg density g/cc | Porosity % | Second order transtion temperature °C. | Strength cN/dtex |
|---|---|---|---|---|---|
| 2 | 1.22 | 0.483 | 60.4 | 128 | 2.1 |
| 3 | 1.21 | 0.769 | 36.8 | 131 | 2.2 |
| 4 | 1.22 | 0.989 | 18.9 | 133 | 2.0 |
| 5 | 1.22 | 0.788 | 35.4 | 130 | 2.1 |

EXAMPLES 6 to 9 (Comparison Examples)

6 a: In the same way as described in Example 1, 74 kg of dimethyl formamide are mixed with 26 kg of the same polycarbonate as in Example 1, dissolved, passed through a heating vessel and filtered. A 26% solution of polycarbonate in DMF is obtained. Tetraethylene glycol heated to 130° C. is added by means of a gear pump through a threeway cock in such a quantity that the ratio by weight of polycarbonate solids to tetraethylene glycol amounts to 3.65:1. After the addition, the hot (130° C.) solutions are homogenised through mixing combs and directly spun from a 240-bore spinning jet. The duct temperature is 180° C., the air temperature is 300° C. and the air throughput is 40 $m^3$/hour. The filaments, which have an overall denier of 2400 dtex, are collected on bobbins and combined to form a tow having an overall denier of 240,000 dtex. The tow is then drawn in a ratio of 1:2.0 in boiling water, washed, treated with an antistatic preparation, dried at 120° C., crimped and cut into staple fibres having a length of 60 mm. The individual fibres have a final denier of 6.3 dtex and a water retention capacity of 12%. The fibres again have a core-jacket structure with a dumbell-like cross-section. The jacket surface makes up approximately 80% of the total cross-sectional area. The fibres have a second order transition temperature of 97° C. According to analysis by gas chromatography, the fibres still contain 6.9% of tetraethylene glycol.

6 b: Part of the doubled tow is repeatedly treated with boiling water before drawing in order to remove the non-solvent tetraethylene glycol. The tow is then aftertreated as described above to form fibres. The fibres have a second order transition temperature of 99° C. and contain 6.4% of the non-solvent, tetraethylene glycol. Their water retention capacity remains unchanged at 12%. Despite intensive washing, it is clearly not possible to remove the non-solvent completely.

Table II below contains further examples. The spinning solutions are spun into core-jacket fibres having a final denier of 6.7 dtex in the same way as described in Example 6 and are aftertreated in the same way as in Examples 6 a and 6 b. The ratio by weight of polymer solids to non-solvent is varied. Tetraethylene glycol is used as the non-solvent. In every case, core-jacket fibres having a dumbell-like to oval cross section are again obtained.

TABLE II

| No. | Ratio of polymer solids to non solvent | WR (according to DIN 53 814 in %) | Contribution of jacket surface to total cross section % |
|---|---|---|---|
| 7 | 2.84:1 | 14 | ~70 |
| 8 | 2.33:1 | 17 | ~45 |
| 9 | 1.98:1 | 20 | ~35 |

| No. | Second order transition temperature °C. after treatment method: according to Example 6a | Second order transition temperature °C. after treatment method: according to Example 6b | Residual non-solvent content in the fibres in % |
|---|---|---|---|
| 7 | 85 | 84 | 13.9 |
| 8 | 75 | 70 | 12.6 |
| 9 | 74 | 70 | 13.9 |

What I claim is:

1. Dry spun, hydrophilic core-jacket filaments and fibres of polycarbonates having a porosity and a water retention capacity of at least 10%, a mercury density of less than 1.0 g/cc, a strength of at least 1.5 cN/dtex and a second order transition temperature of at least 125° C.

2. Filaments and fibres as claimed in claim 1, wherein said polycarbonate is a polycarbonic acid ester of 4,4'-dihydroxydiphenyl-2,2-propane.

* * * * *